US010522314B2

(12) United States Patent
Lee

(10) Patent No.: US 10,522,314 B2
(45) Date of Patent: Dec. 31, 2019

(54) MAGNETIC TRIP DEVICE FOR CIRCUIT BREAKER

(71) Applicant: LSIS CO., LTD., Anyang-si, Gyeonggi-do (KR)

(72) Inventor: Kyuho Lee, Anyang-si (KR)

(73) Assignee: LSIS CO., LTD., Anyang-si, Gyeonggi-Do (KR)

( * ) Notice: Subject to any disclaimer, the term of this patent is extended or adjusted under 35 U.S.C. 154(b) by 78 days.

(21) Appl. No.: 15/855,632

(22) Filed: Dec. 27, 2017

(65) Prior Publication Data

US 2018/0269021 A1 Sep. 20, 2018

(30) Foreign Application Priority Data

Mar. 15, 2017 (KR) ..... 10-2017-0032645

(51) Int. Cl.
*H01H 9/00* (2006.01)
*H01H 71/24* (2006.01)
(Continued)

(52) U.S. Cl.
CPC ..... *H01H 71/2463* (2013.01); *H01H 21/36* (2013.01); *H01H 71/2472* (2013.01);
(Continued)

(58) Field of Classification Search
CPC .. H01H 3/22; H01H 9/02; H01H 9/04; H01H 13/04; H01H 71/12; H01R 9/26
(Continued)

(56) References Cited

U.S. PATENT DOCUMENTS 1,834,550 A * 12/1931 Reed ..... H01H 71/04 200/288
1,976,934 A * 10/1934 Graves, Jr. ..... H01H 71/04 200/308
(Continued)

FOREIGN PATENT DOCUMENTS

CN 103400726 A 11/2013
EP 1975965 A2 10/2008
(Continued)

OTHER PUBLICATIONS

European Search Report for related European Application No. 17206206.6; report dated May 9, 2018; (10 pages).
(Continued)

*Primary Examiner* — Shawki S Ismail
*Assistant Examiner* — Lisa N Homza
(74) *Attorney, Agent, or Firm* — K&L Gates LLP

(57) ABSTRACT

A magnetic trip device comprises an actuator coil part having a plunger; an output plate configured to rotate in a first direction by the pressing of the plunger; a micro switch configured to output an electrical signal indicating a state of the circuit breaker; a switch driving lever mechanism configured to rotate to a first position for pressing the operation lever portion and a second position for releasing the operation lever portion; a driving lever bias spring for elastically pressing the switch driving lever mechanism; an automatic reset mechanism for pressing the plunger to the retracted position; a driving lever latch configured to rotate to a restraining position for preventing the switch driving lever mechanism from rotating to the first position, and a release position; and an avoiding portion formed on the output plate to avoid contacting with the switch driving lever mechanism.

9 Claims, 9 Drawing Sheets

(51) Int. Cl.

| | |
|---|---|
| ***H01H 89/00*** | (2006.01) |
| ***H01H 71/52*** | (2006.01) |
| ***H01H 21/36*** | (2006.01) |
| ***H01H 71/46*** | (2006.01) |
| ***H01H 73/12*** | (2006.01) |
| *H01H 9/16* | (2006.01) |
| *H01H 71/04* | (2006.01) |

(52) U.S. Cl.
CPC ..... *H01H 71/465* (2013.01); *H01H 71/52* (2013.01); *H01H 73/12* (2013.01); *H01H 89/00* (2013.01); *H01H 9/167* (2013.01); *H01H 2071/042* (2013.01); *H01H 2071/467* (2013.01); *H01H 2235/01* (2013.01)

(58) Field of Classification Search
USPC ..... 335/174
See application file for complete search history.

(56) References Cited

U.S. PATENT DOCUMENTS 2,723,326 A * 11/1955 Bank ..... H01H 71/04 116/200
3,182,151 A * 5/1965 Coughlin ..... H01H 9/04 335/15
3,335,375 A * 8/1967 Fujita ..... H01H 50/32 335/18
3,401,363 A * 9/1968 Vyskocil ..... H01H 71/04 335/10
3,443,258 A * 5/1969 Dunham ..... H01H 71/04 335/13
3,596,218 A * 7/1971 Layton ..... H01H 71/04 200/308
3,596,219 A * 7/1971 Erickson ..... H01H 71/04 335/17
3,622,923 A * 11/1971 Shaffer ..... H01H 71/2472 335/17
3,683,350 A * 8/1972 Shedenheim ..... H01H 73/14 335/10
3,742,402 A * 6/1973 Nicol ..... H01H 71/465 335/13
3,970,975 A * 7/1976 Gryctko ..... H01H 71/04 335/18
3,973,230 A * 8/1976 Ciarcia ..... H01H 71/462 335/13
4,001,739 A 1/1977 Powell et al.
4,037,185 A * 7/1977 Klein ..... H01H 71/04 335/17
4,042,896 A * 8/1977 Powell ..... H01H 71/70 335/17
4,056,816 A * 11/1977 Guim ..... H01H 71/46 335/17
4,121,077 A * 10/1978 Mrenna ..... H01H 71/04 200/308
4,124,831 A * 11/1978 Kasahara ..... H01H 71/142 335/16
4,166,989 A * 9/1979 Castonguay ..... H01H 71/04 335/13
4,242,551 A * 12/1980 Sorenson ..... H01H 23/025 200/302.3
4,250,476 A * 2/1981 Evans ..... H01H 9/0066 200/308
4,301,342 A * 11/1981 Castonguay ..... H01H 71/04 200/308
4,301,433 A * 11/1981 Castonguay ..... H01H 71/46 335/13
4,308,511 A * 12/1981 Borona ..... H01H 89/06 307/38
4,347,488 A * 8/1982 Mune ..... H01H 71/1027 335/8
4,382,270 A * 5/1983 Davidson ..... H01H 71/04 335/17
4,417,222 A * 11/1983 Schmitt ..... H01H 1/2066 335/23
4,491,709 A * 1/1985 Chabot ..... H01H 3/3021 200/288
4,506,246 A * 3/1985 Wong ..... H01H 3/30 335/160
4,554,524 A * 11/1985 Radus ..... H01H 73/14 335/17
4,623,859 A * 11/1986 Erickson ..... H01H 3/38 335/14
4,623,861 A * 11/1986 Krasij ..... H01H 71/54 200/303
4,652,867 A * 3/1987 Masot ..... H01H 71/04 340/638
4,760,384 A * 7/1988 Vila-Masot ..... H01H 71/04 335/17
4,768,025 A * 8/1988 Vila-Masot ..... H01H 71/04 335/17
4,801,906 A * 1/1989 Morris ..... H01H 71/465 335/13
4,900,275 A * 2/1990 Fasano ..... H02B 1/052 439/716
4,951,021 A * 8/1990 Theisen ..... H01H 71/1054 335/140
5,003,139 A * 3/1991 Edds ..... H01H 71/0214 200/308
5,041,805 A * 8/1991 Ohishi ..... H01H 71/04 335/14
5,089,796 A * 2/1992 Glennon ..... H01H 83/22 335/172
5,095,293 A * 3/1992 Patel ..... H01H 1/0015 335/17
5,113,043 A * 5/1992 Morris ..... H01H 9/282 200/43.01
5,140,115 A * 8/1992 Morris ..... H01H 9/16 200/308
5,192,941 A * 3/1993 Fishovitz ..... H01H 71/46 335/17
5,223,681 A * 6/1993 Buehler ..... H01H 71/504 218/22
5,252,933 A * 10/1993 Kamino ..... H01H 89/08 335/172
5,258,732 A * 11/1993 Marquardt ..... H01H 71/02 335/132
5,369,385 A * 11/1994 Schulte ..... H01H 73/52 335/167
5,424,701 A * 6/1995 Castonguay ..... H01H 3/30 200/400
5,453,724 A * 9/1995 Seymour ..... H01H 71/322 335/172
5,486,660 A * 1/1996 Fasano ..... H01H 71/1054 200/303
5,541,800 A * 7/1996 Misencik ..... H01H 73/14 335/18
5,607,047 A * 3/1997 Leet ..... H01H 11/0018 200/303
5,657,002 A * 8/1997 Ogden ..... H01H 85/30 335/14
5,701,110 A * 12/1997 Scheel ..... H01H 1/5805 335/132
5,714,940 A * 2/1998 Fishovitz ..... H01H 71/46 200/400
5,723,832 A * 3/1998 Hall ..... H01H 9/286 200/43.16
5,773,778 A * 6/1998 Arnold ..... H01H 71/50 218/153
5,794,759 A * 8/1998 Butts ..... H01H 9/287 200/43.01
5,831,500 A * 11/1998 Turner ..... H01H 71/04 335/17
5,861,784 A * 1/1999 Heise ..... H01H 83/20 200/400
5,907,140 A * 5/1999 Smith ..... H01H 9/287 200/304
5,917,391 A * 6/1999 Mahaney ..... H01H 13/20 335/17

(56) References Cited

U.S. PATENT DOCUMENTS 5,920,451 A * 7/1999 Fasano ..... H01H 73/14 335/18
5,923,261 A * 7/1999 Castonguay ..... H01H 71/465 200/400
5,936,535 A * 8/1999 Rosen ..... H01H 71/465 335/17
5,982,258 A 11/1999 Baginski et al.
6,062,914 A * 5/2000 Fasano ..... H01H 71/08 361/634
6,104,265 A * 8/2000 Maloney ..... H01H 71/462 200/308
6,104,266 A * 8/2000 Tilghman ..... H01H 71/04 335/17
6,107,902 A * 8/2000 Zhang ..... H01H 71/04 200/308
6,130,390 A * 10/2000 Castonguay ..... H01H 71/04 200/308
6,137,385 A * 10/2000 Conway ..... H01H 71/465 335/132
6,140,897 A * 10/2000 Mueller ..... H01H 71/0228 200/43.01
6,144,271 A * 11/2000 Mueller ..... H01H 71/0228 335/167
6,222,433 B1 * 4/2001 Ramakrishnan ..... H01H 1/2058 200/308
6,246,304 B1 * 6/2001 Gasper ..... H01H 71/04 335/17
6,284,991 B1 * 9/2001 Fasano ..... H01H 71/0264 200/296
6,528,744 B2 * 3/2003 Bremner ..... H01H 3/20 200/334
6,600,396 B1 * 7/2003 Rodriguez ..... H01H 71/0228 335/132
6,803,535 B1 * 10/2004 Whipple ..... H01H 71/04 200/308
6,864,450 B1 3/2005 Chen et al.
6,897,747 B2 * 5/2005 Brandon ..... H01H 71/524 335/17
7,034,644 B2 * 4/2006 Moldovan ..... H01H 71/04 335/17
7,411,766 B1 * 8/2008 Huang ..... H01H 71/04 335/13
7,488,913 B1 * 2/2009 Durham ..... H02B 1/052 200/400
7,592,888 B2 * 9/2009 Colsch ..... H01H 71/74 335/176
7,598,828 B1 * 10/2009 Weeks ..... H01H 83/04 335/18
7,649,433 B2 * 1/2010 Eley ..... H01H 71/04 200/308
8,053,694 B2 11/2011 Spitsberg et al.
8,766,749 B2 * 7/2014 Ganley ..... H01H 71/125 335/172
8,836,453 B2 * 9/2014 Yang ..... H01H 9/20 335/167
8,963,662 B2 * 2/2015 Asokan ..... H01H 33/182 335/147
8,973,519 B2 * 3/2015 Bindics ..... H01H 9/16 116/285
9,029,727 B2 * 5/2015 Puhalla ..... H01H 33/20 218/148
9,230,757 B2 * 1/2016 Rego ..... H01H 23/04
9,966,210 B1 * 5/2018 Fasano ..... H01H 33/42
2002/0158724 A1 * 10/2002 Wellner ..... H01H 71/02 335/16
2002/0158725 A1 * 10/2002 Nerstrom ..... H01H 71/04 335/17
2002/0158726 A1 * 10/2002 Wellner ..... H01H 71/04 335/18
2003/0038692 A1 * 2/2003 Schmalz ..... H02H 1/06 335/35
2004/0051605 A1 * 3/2004 Fasano ..... H01H 9/443 335/35
2004/0070474 A1 * 4/2004 Wu ..... H01H 83/04 335/18
2004/0085167 A1 * 5/2004 McCormick ..... H01H 71/46 335/16
2004/0145846 A1 * 7/2004 Fasano ..... H01H 71/123 361/102
2004/0196123 A1 * 10/2004 Simms ..... H01H 1/54 335/6
2005/0046525 A1 * 3/2005 Tongo ..... H01H 73/14 335/17
2005/0046526 A1 * 3/2005 Lipsey, II ..... H01H 73/14 335/17
2005/0140477 A1 * 6/2005 Germain ..... H01H 83/04 335/18
2005/0212628 A1 * 9/2005 Castonguay ..... H01H 89/08 335/20
2005/0212629 A1 * 9/2005 Williams ..... H01H 89/08 335/20
2005/0258921 A1 * 11/2005 Puskar ..... H01H 71/0228 335/17
2006/0071742 A1 * 4/2006 Castonguay ..... H01H 89/08 335/20
2006/0125583 A1 * 6/2006 Mills ..... H01H 71/123 335/172
2006/0202785 A1 * 9/2006 Whipple ..... H01H 71/04 335/17
2007/0085638 A1 * 4/2007 Zindler ..... H01H 71/04 335/132
2007/0132530 A1 * 6/2007 Wang ..... H01H 83/04 335/6
2007/0188276 A1 * 8/2007 Shi ..... H01H 83/04 335/6
2007/0194869 A1 * 8/2007 Titus ..... H01H 71/04 335/172
2007/0200652 A1 * 8/2007 Gibson ..... H01H 71/04 335/17
2007/0229202 A1 * 10/2007 Gao ..... H01H 9/161 335/18
2008/0012664 A1 * 1/2008 DeBoer ..... H01H 51/2209 335/14
2008/0042787 A1 * 2/2008 McCoy ..... H01H 71/04 335/186
2008/0247100 A1 * 10/2008 Fasano ..... H01H 83/02 361/45
2009/0256660 A1 * 10/2009 Babu ..... H01H 71/04 335/17
2010/0026426 A1 * 2/2010 Mortun ..... H01H 73/44 335/18
2010/0073113 A1 * 3/2010 Yang ..... H01H 71/123 335/15
2010/0226053 A1 * 9/2010 Kamor ..... H01H 83/04 361/42
2011/0141633 A1 * 6/2011 Fasano ..... H01H 83/02 361/42
2011/0181379 A1 * 7/2011 Sohn ..... H01H 71/04 335/17
2012/0037598 A1 * 2/2012 Fasano ..... H01H 9/36 218/22
2012/0085627 A1 * 4/2012 Yang ..... H01H 71/46 200/43.16
2012/0168295 A1 * 7/2012 Lin ..... H01H 73/52 200/560
2012/0262255 A1 * 10/2012 Fasano ..... H01H 71/2409 335/7
2013/0088310 A1 * 4/2013 Yang ..... H01H 9/20 335/14
2013/0180956 A1 * 7/2013 Fasano ..... H01H 33/20 218/148
2013/0241677 A1 * 9/2013 Padro ..... H01H 83/144 335/18
2013/0241678 A1 * 9/2013 Bonasia ..... H01H 83/04 335/18
2013/0278361 A1 * 10/2013 Weeks ..... H05K 5/02 335/6

(56) References Cited

U.S. PATENT DOCUMENTS

2014/0062623 A1* 3/2014 Fasano ..... H01H 71/2463 335/16
2014/0076700 A1* 3/2014 Lin ..... H01H 9/48 200/304
2014/0083828 A1* 3/2014 Maloney ..... H01H 11/00 200/304
2014/0139302 A1* 5/2014 Rubbo ..... H01H 71/04 335/17
2014/0251959 A1* 9/2014 Fasano ..... H01H 9/30 218/155
2015/0035629 A1* 2/2015 Thomas ..... H01H 71/04 335/38
2015/0070114 A1* 3/2015 Fasano ..... H01H 71/32 335/21
2015/0200533 A1* 7/2015 Simonin ..... H02H 3/05 335/17
2016/0049263 A1* 2/2016 Maloney ..... H01H 3/04 335/21
2016/0049274 A1* 2/2016 Maloney ..... H01H 71/025 335/21
2016/0135313 A1* 5/2016 Freeman ..... H01H 3/02
2016/0163488 A1* 6/2016 Maloney ..... H01H 71/2472 335/15
2016/0379789 A1* 12/2016 Fasano ..... H01H 71/40 335/18
2017/0032905 A1* 2/2017 Fasano ..... H01H 9/26
2017/0047185 A1* 2/2017 Fasano ..... H01H 71/08
2017/0103861 A1* 4/2017 Reid ..... H01H 9/02
2018/0123326 A1* 5/2018 Luoma ..... H02B 1/26
2018/0130616 A1* 5/2018 Fasano ..... H01H 73/12
2018/0218864 A1* 8/2018 Fasano ..... H01H 50/041
2019/0019636 A1* 1/2019 Maloney ..... H01H 9/02
2019/0074153 A1* 3/2019 Fasano ..... H01H 71/04

FOREIGN PATENT DOCUMENTS

| | | | |
|---|---|---|---|
| EP | 2015340 | A2 | 1/2009 |
| JP | 07094070 | A | 7/1995 |
| JP | 2001160354 | A | 6/2001 |
| JP | 2009004101 | A | 1/2009 |
| KR | 100424355 | B1 | 6/2004 |
| KR | 100905019 | B1 | 6/2009 |
| KR | 101082175 | B1 | 11/2011 |
| KR | 20110135236 | A | 12/2011 |

OTHER PUBLICATIONS

Chinese Office action for related Chinese Application No. 201810089196.4; action dated Mar. 21, 2019; (7 pages).

* cited by examiner

MAGNETIC TRIP DEVICE FOR CIRCUIT BREAKER

CROSS-REFERENCE TO RELATED APPLICATIONS

Pursuant to 35 USC § 119(a), this application claims the benefit of an earlier filing date of and the right of priority to Korean Application No. 10-2017-0032645, filed on Mar. 15, 2017, which is herein expressly incorporated by reference in its entirety.

BACKGROUND OF THE INVENTION

1. Field of the Invention

The present disclosure relates to a circuit breaker, and more particularly to, a magnetic trip device for a circuit breaker.

2. Description of the Related Art

The present disclosure may be applicable to an air circuit breaker, particularly a small air circuit breaker, but may not be necessarily applicable to only a small air circuit breaker, and may be also applicable to various circuit breakers having a magnetic trip device.

For a prior art relating to such a magnetic trip device, the following patent documents assigned to the applicant of the present disclosure may be referred to.

Korean Patent Registration No. 10-1082175 (Title of invention: Circuit breaker with trip alarm means)

Korean Patent Registration No. 10-0905019 (Title of invention: Circuit breaker having trip signal output device)

However, a magnetic trip device of a conventional circuit breaker including the related art according to the foregoing patent documents has a problem in which there is no means capable of maintaining fault information indicating until a user removes the cause of an accident subsequent to a trip operation and stops fault information indicating.

Such a problem poses a risk of causing serious an electrical safety accident when the circuit breaker is operated to a closed position (a so-called ON position) prior to eliminating the cause of the accident.

Furthermore, a magnetic trip device of a circuit breaker in the related art including conventional technologies according to the foregoing patent documents has a problem in which there is no automatic reset means capable of automatically initializing a position of an actuator coil part in conjunction with a main switching shaft during a trip operation to prepare for a next trip operation.

In addition, a magnetic trip device of a circuit breaker in the related art including conventional technologies according to the foregoing patent documents has a problem in which there is no means capable of maintaining fault information indicating independently of a return operation of the magnetic trip device until a manual initialization operation.

SUMMARY OF THE INVENTION

Accordingly, the present disclosure is to solve the foregoing problems in the related art, and an objective of the present disclosure is to provide a magnetic trip device for a circuit breaker capable of maintaining fault information indicating until a user removes the cause of an accident subsequent to a trip operation and stops fault information indicating, provided with an automatic reset means automatically initializing a position of an actuator coil part in conjunction with a main switching shaft during a trip operation to prepare for a next trip operation, and provided with a means capable of maintaining fault information indicating independently of an operation of the automatic reset means until a manual initialization operation.

The object of the present disclosure can be accomplished by providing a magnetic trip device for a circuit breaker according to this disclosure, comprising:

an actuator coil part that has a plunger configured to move to an advanced position or a retracted position according to the magnetization or demagnetization of a coil; an output plate that is rotatably provided on a movement path of the plunger to rotate in a first direction by the pressing of the plunger; a micro switch that has an operation lever portion protruding outward and is configured to output an electrical signal indicating a state of the circuit breaker according to whether or not the operation lever portion is pressed; a switch driving lever mechanism that is configured to rotate to a first position for pressing the operation lever portion and a second position for releasing the operation lever portion so as to open or close the micro switch; a driving lever bias spring that is provided at a predetermined position to elastically press the switch driving lever mechanism to rotate to the second position; an automatic reset mechanism that is configured to press the plunger of the actuator coil part to the retracted position in interlocking with a main switching shaft of the circuit breaker subsequent to a trip operation; a driving lever latch that is configured to rotate to a restraining position for preventing the switch driving lever mechanism from rotating to the first position even when the plunger is moved to the retracted position by the automatic reset mechanism so as to allow the micro switch to maintain a trip indicating state subsequent to a trip operation, and a release position for allowing the switch driving lever mechanism to rotate to the first position, and provided adjacent to the switch driving lever mechanism; and an avoiding portion that is formed on the output plate to avoid contacting with the switch driving lever mechanism for a mutually independent operation between the switch driving lever mechanism and the output plate.

According to one preferred aspect of this disclosure, the magnetic trip device further comprises a manual reset lever that is provided at a position capable of pressing the switch driving lever mechanism and the driving lever latch to press the switch driving lever mechanism to be located at a first position, and pressing the driving lever latch to rotate to the release position while being moved by a manual operation force.

According to another preferred aspect of this disclosure, the driving lever latch comprises: a rotating shaft portion; a hook portion that is extended from the rotating shaft portion toward the switch driving lever mechanism to restrain the switch driving lever mechanism; and a release driving force receiving portion that is extended from the rotating shaft portion to an opposite side of the hook portion to contact with the manual reset lever, wherein the manual reset lever comprises a pressing protrusion portion that is configured to press the release driving force receiving portion to rotate the driving lever latch to the release position.

According to still another preferred aspect of this disclosure, the release driving force receiving portion is configured such that a surface facing the pressing protrusion portion is an inclined surface.

According to still another preferred aspect of this disclosure, the automatic reset mechanism comprises: a rotating shaft; a rotating plate that is rotatably supported by the rotating shaft; a cylinder that has a lower portion located to pass through a through hole of the rotating plate; a bushing that is provided with a vertical long hole to be coupled to the cylinder by a coupling pin inserted into the long hole; a pressing rod that is coupled to the bushing to press in direct contact with the plunger of the actuator coil part as an output portion of the automatic reset mechanism; a driving lever that is coupled to the main switching shaft of the circuit breaker to be rotatable together, the driving lever having a cam surface portion; and a power receiving portion that is provided to extend from the rotating plate toward the driving lever to bring into contact with the cam surface portion of the driving lever to receive power during a trip operation.

According to still another preferred aspect of this disclosure, the automatic reset mechanism further comprises: a first buffer spring that is provided between the bushing and the rotating plate to buffer an impact when the pressing rod pushes up the plunger to the retracted position; and a return spring that is connected to the rotating plate, and tensioned when the main switching shaft is in a trip position to charge elastic energy, and when the main switching shaft is in a closing position to rotate the rotating plate and the power receiving portion in a first direction by discharging the charged elastic energy.

According to still another preferred aspect of this disclosure, the switch driving lever mechanism comprises: an arm that is extending toward the operation lever portion of the micro switch and rotatable to a first position for pressing the operation lever portion of the micro switch and a second position for releasing the operation lever portion; and a switch driving lever that is capable of rotating the arm, wherein the switch driving lever comprises: a rotating shaft portion; a first lever portion that is extending from the rotating shaft portion toward the output plate to rotate along the output plate; an arm contact surface portion that contacts with the arm to transmit a driving force to the arm so as to rotate the arm to the first position or the second position; and a third lever portion that is extending upward from the rotating shaft portion.

According to still another preferred aspect of this disclosure, the avoiding portion is formed on the output plate, and configured with a concave groove portion formed in a concave shape to prevent the switch driving lever mechanism from being interfered with the output plate rotating to an initial position.

According to still another preferred aspect of this disclosure, the avoiding portion is configured with a through hole portion formed to pass through the output plate such that the switch lever mechanism is avoided without being interfered with the output plate.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

The foregoing objective of the present disclosure, as well as the configuration and working effect thereof to accomplish the foregoing objective will be more clearly understood by the following description for preferred embodiments of present disclosure with reference to the accompanying drawings.

Figure 1:
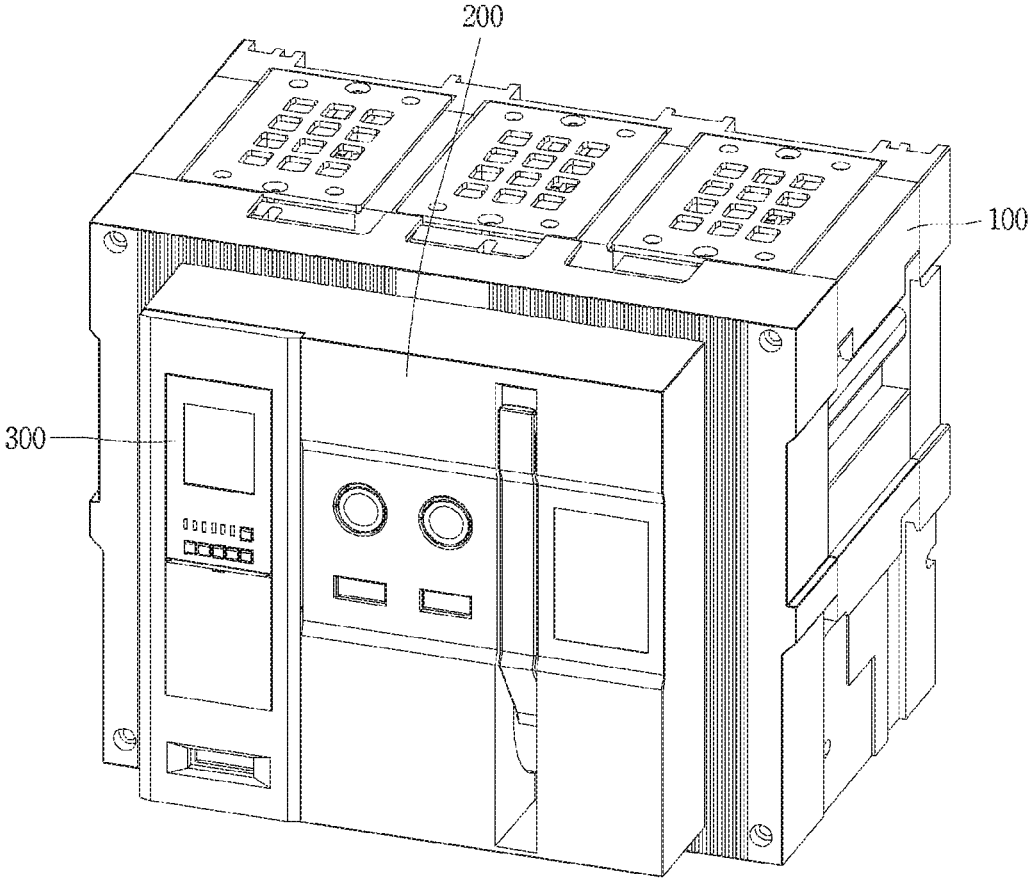
FIG. 1 is a perspective view illustrating an outline of an air circuit breaker to which a magnetic trip device for a circuit breaker according to the present disclosure is applicable.

A circuit breaker, for example, an air circuit breaker, on which a magnetic trip device for a circuit breaker according to a preferred embodiment of the present disclosure is mountable (applicable), may be configured with reference to FIG. 1. Referring to FIG. 1, the air circuit breaker includes a main body 100 having a switching mechanism and an arc extinguishing mechanism, and a front panel part 200 having an operation and display unit, and an over current relay 300 as a controller of the air circuit breaker is provided at one side of the front panel part 200. FIG. 1 is an external perspective view illustrating only the external shapes of the constituent parts.

On the other hand, the configuration of a magnetic trip device for a circuit breaker according to a preferred embodiment of the present disclosure will be described as follows mainly with reference to FIGS. 2 and 3.

As illustrated in the drawing, a magnetic trip device 20 for a circuit breaker according to a preferred embodiment of the present disclosure comprises an actuator coil part 21, an output plate 22, a micro switch 28, a switch driving lever mechanism 26, 27, a driving lever bias spring 32, an automatic reset mechanism 23, a driving lever latch 29, and an avoiding portion 22*d*, 22*e*.

Figure 2:
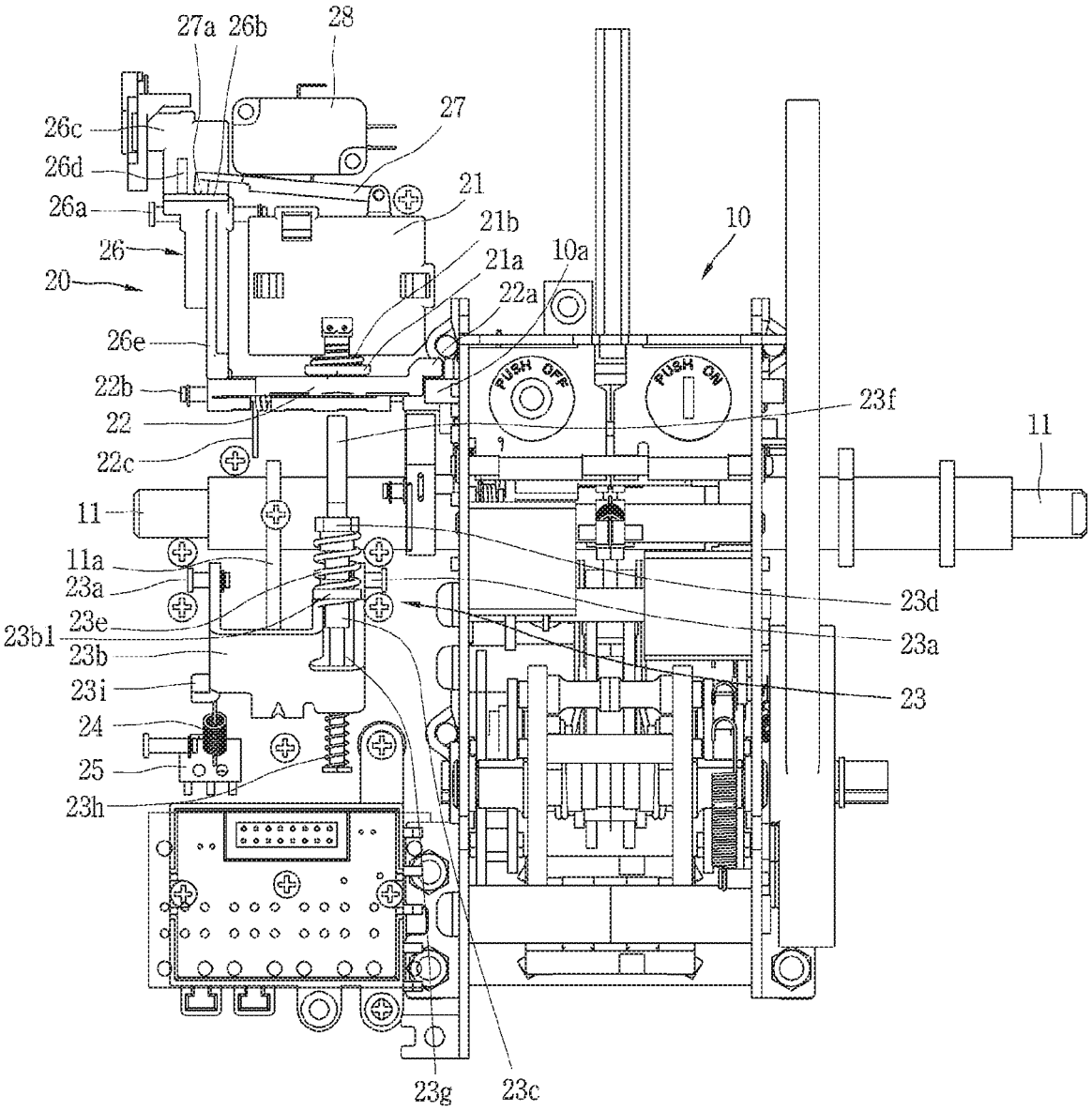
FIG. 2 is a front view illustrating a magnetic trip device according to an embodiment of the present disclosure, a switching mechanism, and a main switching shaft of a circuit breaker in a closing state and in a state where alarm indicating is stopped.
Figure 3:
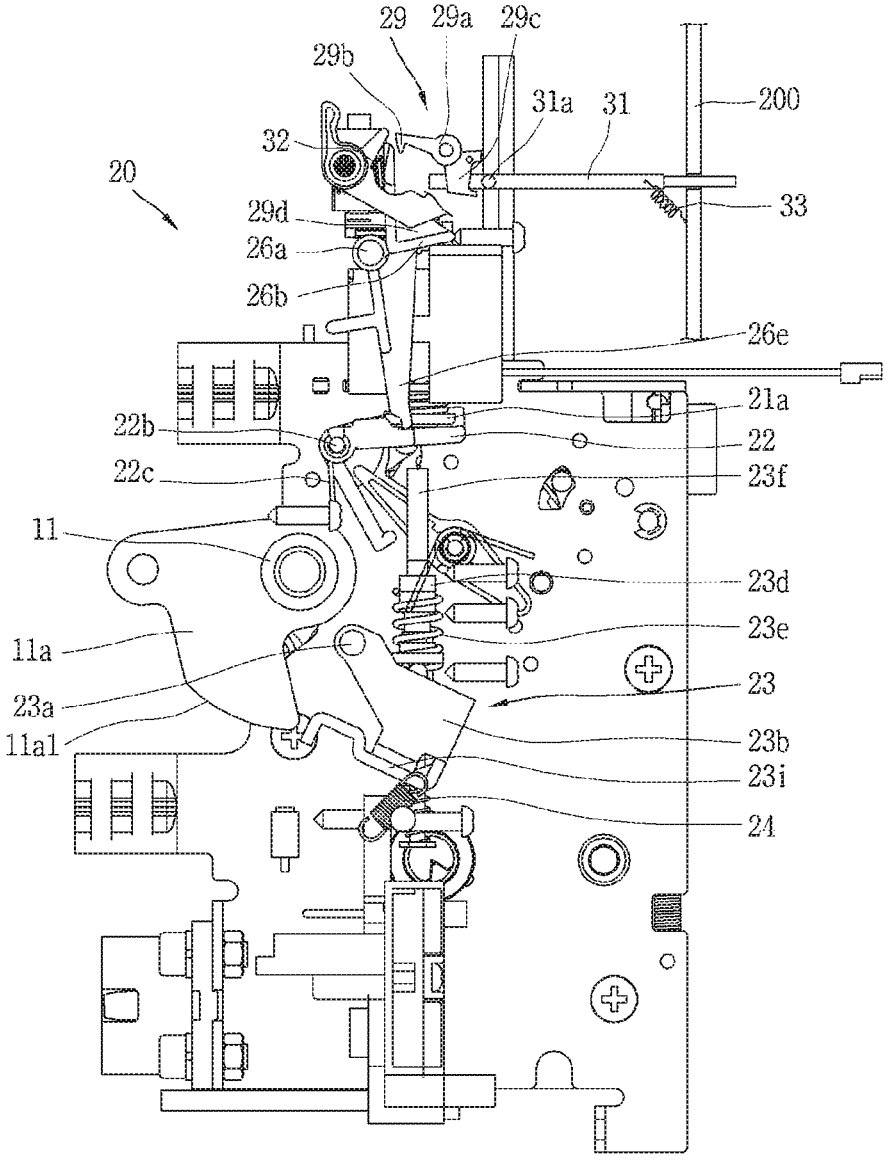
FIG. 3 is a left side view illustrating the magnetic trip device according to an embodiment of the present disclosure, the switching mechanism, and the main switching shaft of the circuit breaker in the state of FIG. 2.

Referring to FIGS. 2 and 3, and the like, reference numeral 10 designates a switching mechanism of the circuit breaker, and the switching mechanism 10 may comprises a trip spring as an energy source for a trip operation (automatic circuit breaking operation), and a closing spring as an energy source for a closing operation (a so-called ON operation), a power transmission mechanism, a movable contact arm, a stationary contact arm, and the like.

The more detailed description of the switching mechanism 10 and the configuration thereof may be referred to the disclosure of Korean Patent No. 10-1100709 granted to the applicant of this disclosure, and the detailed description thereof will be omitted.

Referring to FIGS. 2 and 3, and the like, reference numeral 11 designates a main switching shaft commonly connected to a plurality of movable contact arms for each phase for a closing operation for simultaneously bringing a plurality of movable contact arms for each phase (pole) into contact with the corresponding stationary contact arm, and an opening operation for opening (tripping) the plurality of movable contact arms from the stationary contact arms.

The actuator coil part 21 includes a coil (not shown) magnetized or demagnetized according to whether or not a magnetization control signal is received from the over current relay 300, and plunger 21*a* configured to move an advanced position or retracted position according to the magnetization or demagnetization of the coil.

A buffer spring 21*b* may be additionally provided around an axis of the plunger 21*a* to buffer an impact when the plunger 21*a* collides with the output plate 22. Here, the over current relay 300 outputs the magnetization control signal only when the circuit breaker is to be tripped.

The output plate 22 serves as an output portion of the magnetic trip device 20 of the present disclosure, and referring to FIG. 2, the output plate 22 presses a trip lever 10*a* of the switching mechanism 10 to trigger the switching mechanism 10 to perform a trip operation.

The output plate 22 may be provided with a lever pressing portion 22*a* on one side as an operating portion for pressing the trip lever 10*a*.

According to an embodiment, referring to FIG. 2, the lever pressing portion 22*a* is provided to protrude upward from the other plate surfaces of the output plate 22 so as to provide a space for an end portion of the trip lever 10*a* to be located immediately therebelow.

A central portion of the output plate 22 is provided with a through hole (refer to FIG. 4, reference number is not given) for allowing a pressing rod 23*f* as an upper end portion of a lower automatic reset mechanism 23 to pass therethrough.

It may be possible for the pressing rod 23*f* moving upward through the through-hole to push the plunger 21*a* of the actuator coil part 21 into a retracted position so as to initialize the plunger 21*a*.

The triggered switching mechanism 10 discharges elastic energy charged in the trip spring as well known to separate the movable contact arm from the corresponding stationary contact arm by interlocking mechanical components included in the switching mechanism 10, thereby completing a trip operation for automatically breaking the circuit.

The output plate 22 is rotatably provided on a movement path of the plunger 21*a*, and rotates in a first direction (clockwise direction in FIG. 3) by the pressing of the plunger 21*a*.

An output plate rotating shaft 22*b* may be provided to rotatably support the output plate 22, and both end portions of the output plate rotating shaft 22*b* can be supported by both side plates of an enclosure of the magnetic trip device 20.

According to a preferred aspect of the present disclosure, the magnetic trip device 20 according to the present disclosure further comprises a return spring 22*c* for applying an elastic force to return the output plate 22 to an initial position. Accordingly, when the plunger 21*a* is retracted to eliminate a pressure applied to the output plate 22, the output plate 22 returns to the initial position while rotating in a second direction (counter-clockwise in FIG. 3) due to a resilient force imposed by the return spring 22*c*.

According to a preferred aspect, an elastic modulus of the return spring 22*c* may be configured to be greater than that (elastic modulus) of the driving lever bias spring 32.

Accordingly, when the output plate 22 returns to an initial position while rotating in a counter clockwise direction in the drawing due to an elastic force imposed by the return spring 22*c*, the elastic force imposed by the return spring 22*c* overcomes an elastic force of the driving lever bias spring 32 for rotating the switch driving lever 26 which will be described later in a counter-clockwise direction to rotate the switch driving lever 26 in a counter-clockwise direction, and allows the driving lever bias spring 32 to maintain in a state of charging an elastic energy (a compressed state).

The micro switch 28 is a means for outputting an electrical signal or not according to whether or not a mechanical pressure is received, and has an operation lever portion (refer to 28*a* in FIG. 6), thereby outputting an electrical signal indicating the state of the circuit breaker whether or not a mechanical pressure is received. For instance, when a pressure applied to the operation lever portion 28*a* is eliminated, a circuit from an electric power source to an output terminal is connected (closed) while an internal contact interlocked with the operation lever portion 28*a* is closed to output an electric signal of a predetermined voltage indicating that the circuit breaker is in a trip operation state.

The switch driving lever mechanism 26, 27 is a means (unit) rotatable to a first position for pressing the operation lever portion 28*a* and a second position for releasing the operation lever portion 28*a* so as to open or close the micro switch 26.

According to a preferred embodiment, the switch driving lever mechanism 26, 27 may include a switch driving lever 26 and an arm 27.

The switch driving lever 26 is provided as a means (unit) capable of rotating the arm 27. The switch driving lever 26 includes a rotating shaft portion 26*a*, a first lever portion 26*e*, an arm contact surface portion 26*b*, and a third lever portion 26*c*.

The rotating shaft portion 26*a* is a portion that provides a rotational center axis to allow the switch driving lever 26 to rotate.

The first lever portion 26*e* extends from the rotating shaft portion 26*a* toward the output plate 22 (extends downward in the drawing), and contacts with an upper surface of the output plate 22 to be pressed by the output plate 22. Furthermore, the first lever portion 26*e* is rotatable along the output plate 22.

In particular, the third lever portion 26*c* as an upper portion of the switch driving lever 26 receives an elastic force from the driving lever bias spring 32 to rotate in a clockwise direction in FIG. 3. When the output plate 22 is separated from the first lever portion 26*e* to eliminate a pressure that has been pressed while rotating in a clockwise direction due to the pressing of the plunger 21*a*, the first lever portion 26*e* rotates in a clockwise direction due to an elastic force imposed from the driving lever bias spring 32.

The arm contact surface portion 26*b* is a portion that brings into contact with the arm 27 of the switch driving lever 26 to transmit a driving force to the arm 27 such that the arm 27 rotates to the first position or the second position.

The arm contact surface portion 26*b* is located at a longitudinal center portion of the switch driving lever 26, and extends in a horizontal direction from the rotating shaft portion 26*a* to be located below a power receiving end portion 27*a* of the arm 27.

A reinforcing thick portion 26*d* for reinforcing a strength of a third lever portion 26*c* and the arm the contact surface portion 26*b* which will be described later may be provided between the arm contact surface portion 26*b* and the third lever portion 26*c*. The reinforcing thick portion 26*d* may be formed to have a substantially triangular side shape as illustrated in FIG. 3.

The third lever portion 26*c* is a portion of the switch driving lever 26 that extends upward from the rotating shaft portion 26*a* to be restrained (locked) or released by the driving lever latch 29.

Referring to FIG. 3, a front end portion of the third lever portion 26*c*, which faces the driving lever latch 29, is formed to have an inclined surface or a curved surface so as to allow a hook portion 29*b* of the driving lever latch 29 which will be described later to ride over easily while being in contact therewith.

Furthermore, according to a preferred embodiment, a rear surface of the third lever portion 26*c* is formed with a flat surface, and thus the third lever portion 26*c* is configured not to be easily released from the hook portion 29*b* of the driving lever latch 29 after the hook portion 29*b* rides over the front end portion of the third lever portion 26*c*.

Furthermore, according to a preferred aspect, a spring supporting seat portion may be provided as a protruding portion inserted into the driving lever bias spring 32 on a rear surface of the third lever portion 26*c* to support one end portion of the driving lever bias spring 32.

The arm 27 extends toward the operation lever portion 28*a* of the micro switch 28 to rotate to a first portion for pressing the operation lever portion 28*a* of the micro switch 28 and a second position for releasing the operation lever portion 28*a*.

According to an embodiment, one end portion of the arm 27 may be supported by a hinge and a hinge supporting bracket provided at one side of an upper surface of the actuator coil part 21.

According to another preferred embodiment, the switch driving lever mechanism may be configured with only the switch driving lever 26. Such another embodiment is characterized in that the switch driving lever 26 includes a component portion that performs a function of the arm 27.

In other words, as a switch driving lever mechanism according to another preferred embodiment, the switch driving lever 26 may include a rotating shaft portion 26*a*, a first lever portion 26*e*, a second lever portion, and a third lever portion 26*c*.

Since the rotating shaft portion 26*a*, the first lever portion 26*e* and the third lever portion 26*c* have the same function and configuration as those of the portions indicated by the same reference numerals in the switch driving lever mechanism according to the foregoing embodiment, and thus the detailed description of these components will be omitted.

The first lever portion 26*e* extends from the rotating shaft portion 26*a* toward the output plate 22 to be rotatable along the output plate 22.

The second lever portion is a portion of the switch lever 26 that performs a function of the arm 27, and can be provided by forming the arm contact surface portion 26*b* of the embodiment to extend toward the operation lever portion 28*a* of the micro switch 28.

The second lever portion is a portion of the switch driving lever 26 that extends from the rotating shaft portion 26*a* toward the operation lever portion 28*a* of the micro switch 28 to be rotatable to a first position for pressing the operation lever portion 28*a* and a second position for releasing the operation lever portion 28*a*.

The third lever portion 26*c* extends upward from the rotating shaft portion 26*a* to be restrained (locked) or released by the driving lever latch 29.

Meanwhile, the driving lever bias spring 32 included in the magnetic trip device 20 according to the present disclosure is provided at a predetermined position to elastically press the switch driving lever mechanism to rotate to the second position.

The driving lever bias spring 32 may be configured with a compression spring according to a preferred embodiment, and an end portion of the driving lever bias spring 32 can be supported by the spring supporting seat portion provided on a rear surface of the third lever portion 26*c*, and the other end thereof can be supported by a spring support member (reference number is not given) provided to face the third lever portion 26*c* and is fixed.

The automatic reset mechanism 23 included in the magnetic trip device 20 according to the present disclosure is a means (unit) that drives the plunger 21*a* of the actuator coil part 21 to the retracted position in interlocking with the main switching shaft 11 of the circuit breaker subsequent to a trip operation.

Referring to FIG. 2 or 3, the automatic reset mechanism 23 comprises a rotation shaft 23*a*, a rotating plate 23*b*, a cylinder 23*c*, a bushing 23*d*, a pressing rod 23*f*, a driving lever 11*a*, and a power receiving portion 23*i*.

The automatic reset mechanism 23 may further comprise a first buffer spring 23*e*, a return spring 24, and a spring support member 25.

Furthermore, the automatic reset mechanism 23 may further comprise a lower rod 23*g* and a second buffer spring 23*h*.

The rotation shaft 23*a* is fixedly provided to support the rotating plate 23*b* so as to be rotatable. According to a preferred embodiment, the rotation shaft 23*a* can be configured with a pair of protruding shaft portions formed to protrude from a wall surface of the enclosure (not shown) of the magnetic trip device 20 according to the present disclosure.

The rotating plate 23*b* is rotatable around the rotation shaft 23*a*, and provided at a position facing the driving lever 11*a* to be brought into contact with the driving lever 11*a* coupled to the rotating plate 23*b* to rotate together with the main switching shaft 11 at a side of the main switching shaft 11 of the circuit breaker.

Figure 5:
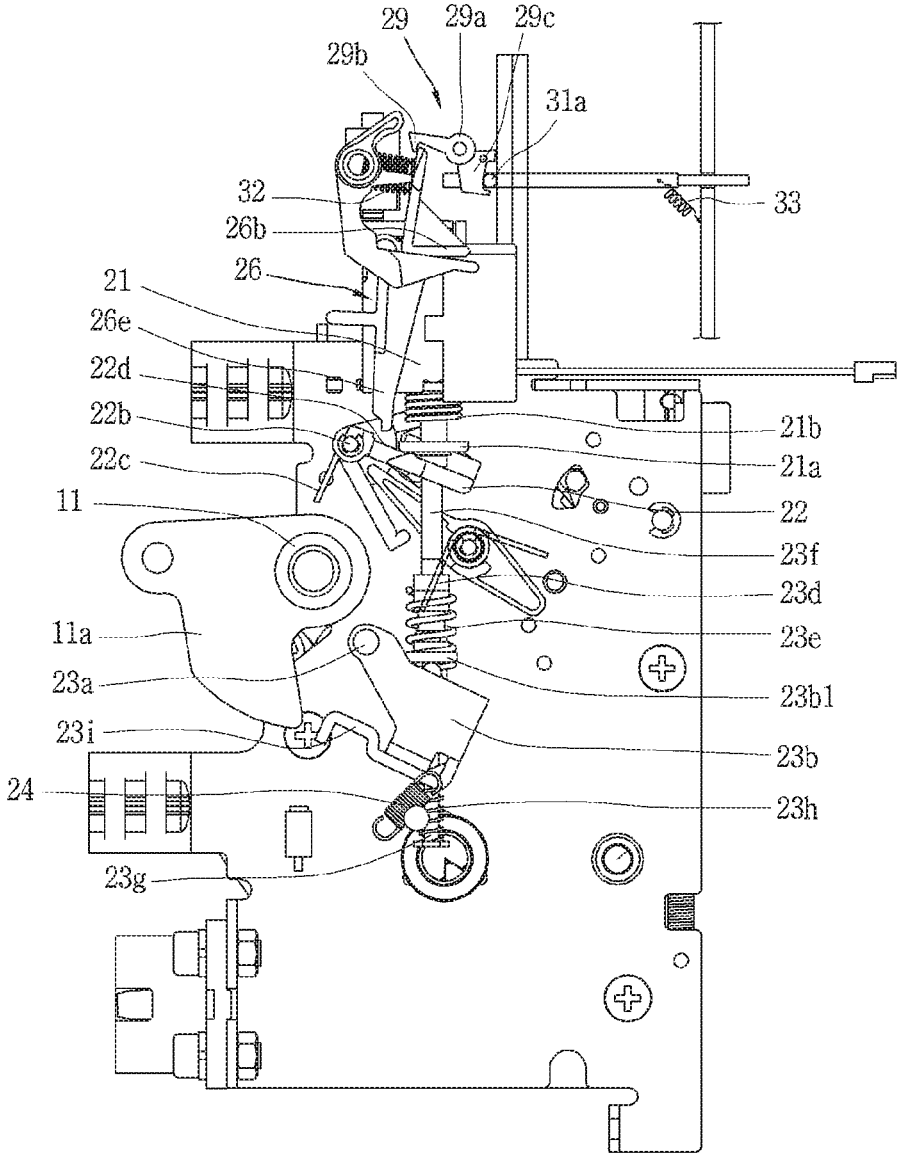
FIG. 5 is a left side view illustrating the magnetic trip device according to an embodiment of the present disclosure, the switching mechanism, and the main switching shaft of a circuit breaker in the state of FIG. 4.

The rotating plate 23*b* may be made of a metallic plate having a substantially U-shape, and includes both leg portions supported by the rotation shaft 23*a*, a spring seat portion 23*b*1 provided between the both leg portions as a portion for supporting one end portion of the first buffer spring 23*e* and a pair of leg portions 23*a*, and a power receiving portion 23*i* extended to be contactable with the driving lever 11*a* as illustrated in FIG. 3 or 5.

The spring seat portion 23*b*1 of the rotating plate 23*b* is provided with a through hole (not shown) for allowing the cylinder 23*c* to pass therethrough in a vertical direction.

A lower portion of the cylinder 23*c* may be placed through the through hole of the rotating plate 23*b*, and a coupling pin (not shown) may be connected to an upper portion of the cylinder 23*c*, and the cylinder 23*c* can be coupled to the bushing 23*d* by inserting the coupling pin into a long hole (not shown) provided vertically on the bushing 23*d*.

A long hole (not shown) in a vertical direction may be also provided at a lower portion of the cylinder 23*c*, and the cylinder 23*c* can be coupled to the lower rod 23*g* by inserting a coupling pin (not shown) connected to the lower rod 23*g* into the long hole.

The bushing 23*d* is integrally (in a single body) coupled to the pressing rod 23*f* to be movable up and down together.

A diameter of the bushing 23*d* is larger than that of the cylinder 23*c* and that of the first buffer spring 23*e* to support the other end of the first buffer spring 23*e* not to be detached therefrom. As described above, the bushing 23*d* may be provided with a vertical long hole and coupled to the cylinder 23*c* by the coupling pin.

The function of the bushing 23*d* is to support the other end of the first buffer spring 23*e* not to be detached therefrom as described above, and at the same time, to connect the pressing rod 23*f* and the cylinder 23*c* in the middle.

The pressing rod 23*f* as an output portion of the automatic reset mechanism 23 is capable of directly contacting and pressing the plunger 21*a* of the actuator coil part 21, and is installed in an upright posture in a vertical direction.

The pressing rod 23*f* can be coupled to the bushing 23*d* in various methods such as welding, screw coupling, connection pin coupling, and the like.

A driving lever 11*a* which is rotatable in the same direction along with the main switching shaft 11 is provided at a position facing the automatic reset mechanism 23 of the main switching shaft 11 to interlock the main switching shaft 11 with the automatic reset mechanism 23.

Here, the driving lever 11*a* has a cam surface portion 11*a*1 whose radius of curvature changes in order to interlock the automatic reset mechanism 23 to operate. The cam surface portion 11*a*1 may be formed on at least a part of an outer circumferential surface of the driving lever 11*a*.

Referring to FIG. 3, when the circuit breaker is in a closing state, the power receiving portion 23*i* is in a state of being separated from the driving lever 11*a* of the main switching shaft 11.

Figure 7:
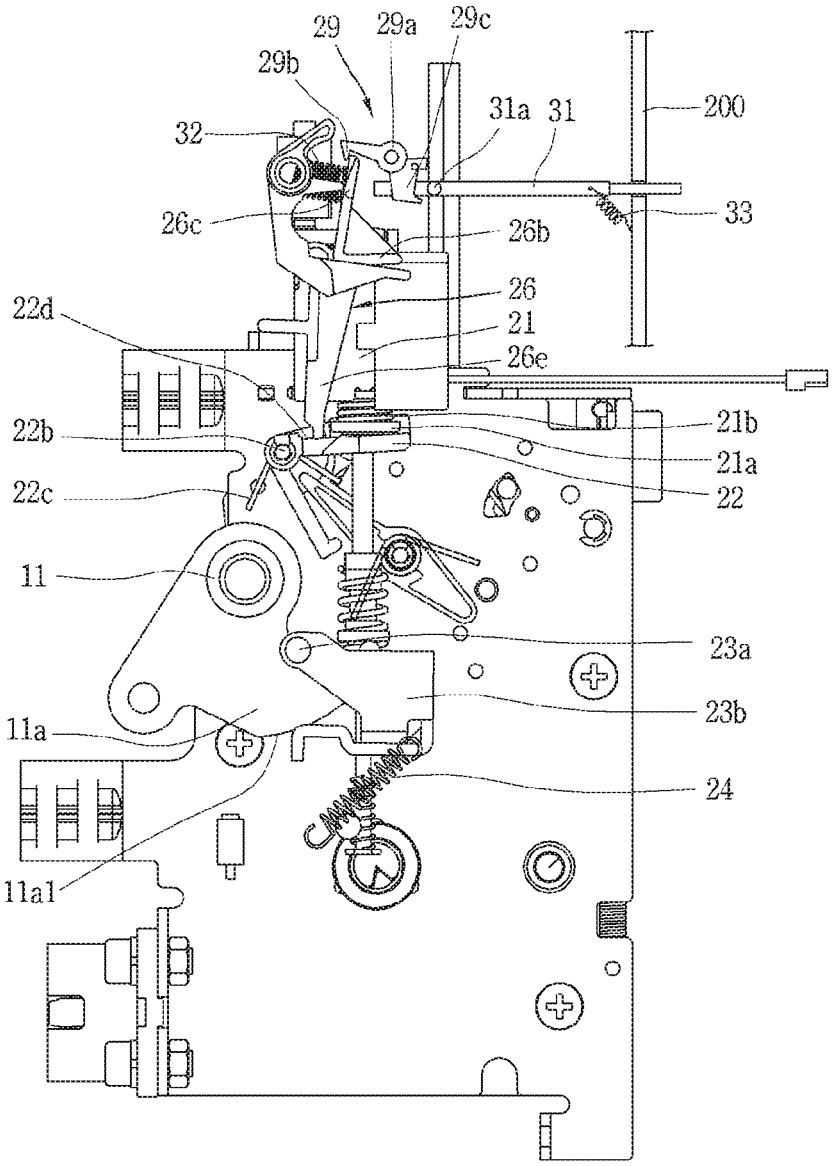
FIG. 7 is a left side view illustrating a magnetic trip device according to an embodiment of the present disclosure the switching mechanism, and the main switching shaft of the circuit breaker in the state of FIG. 6.

Referring to FIG. 7, when the circuit breaker is in a trip state, the power receiving portion 23*i* is pushed in contact with the cam surface portion 11*a*1 of the driving lever 11*a* being rotated and rotated in a counter-clockwise direction.

At this time, the rotating plate 23*b* also rotates in a counter-clockwise direction by the counter-clockwise rotation of the power receiving portion 23*i*. As a result, the bushing 23*d* connected to the rotating plate 23*b* via the first buffer spring 23*e*, the pressing rod 23*f* and the cylinder 23*c* coupled to the bushing 23*d*, the lower rod 23*g* connected to the cylinder 23*c* by the coupling pin, and the second buffer spring 23*h* provided around the lower rod 23*g* move upward.

Thus, the pressing rod 23*f* moving upward presses the plunger 21*a* to return to a retracted position.

A spring support (not shown) for hanging and supporting one end portion of the return spring 24 (not shown) may be provided at one side of the power receiving portion 23*i*, and through hole portions (not shown) may be provided at a left and a right side of the relevant spring support to allow one end portion (hook type end portion) of the return spring 24 to pass therethrough.

The first buffer spring 23*e* can be configured with a compression spring and provided between the bushing 23*d* and the spring seat portion 23*b*1 of the rotating plate 23*b*. When the pressing rod 23*f* moving upward pushes up the plunger 21*a* of the actuator coil part 21 to the retracted position, the first buffer spring 23*e* buffers an impact while being compressed.

The return spring 24 can be configured with a tension spring whose one end is supported by the power receiving portion 23*i* and the other end is supported by the spring support member 25.

When the main switching shaft 11 is at a trip position, the return spring 24 is extended by pulling of the rotating plate 23*b* and the power receiving portion 23*i* that rotate in a counter-clockwise direction to charge elastic energy as illustrated in FIG. 7. And when the main switching shaft 11 is at a closing position of the circuit breaker, the return spring 24 discharges the charged elastic energy to rotate the rotating plate 23*b* and the power receiving portion 23*i* in a clockwise direction as illustrated in FIG. 3.

When the main switching shaft 11 is in a state of being rotated to the closing position (the state of being rotated in a clockwise direction from a position illustrated in FIG. 7 to the position illustrated in FIG. 3), in other words, when the driving lever 11*a* of the main switching shaft 11 is separated from the power receiving portion 23*i*, the return spring 24 applies an elastic force to the rotating plate 23*b* through the power receiving portion 23*i* to rotate the rotating plate 23*b* in a clockwise direction from the position illustrated in FIG. 7 to the position illustrated in FIG. 3.

Due to a clockwise rotation of the rotating plate 23*b*, the bushing 23*d* connected to the rotating plate 23*b* via the first buffer spring 23*e*, the pressing rod 23*f* and the cylinder 23*c* coupled to the bushing 23*d*, the lower rod 23*g* connected to the cylinder 23*c* by the coupling pin, and the second buffer spring 23*h* provided around the lower rod 23*g* move downward.

The spring support member 25 is fixed in position and may support the other end portion of the return spring 24. The spring support member 25 may be integrally formed with the enclosure of the magnetic trip device 20 according to the present disclosure (preferably, the enclosure formed by molding a synthetic resin material having electrical insulation properties) or configured with a separate body from the enclosure and fixed to the enclosure by a fixing means such as a screw.

The spring support member 25 may have a hook supporting portion and a hook receiving groove portion to hang and support the other end of the return spring 24.

As the coupling pin (not shown) connected to the lower rod 23*g* is inserted into a vertical long hole (not shown) provided at a lower portion of the cylinder 23*c* as described above, the lower rod 23*g* can be coupled to the cylinder 23*c* to move up or down together with the cylinder 23*c* according to the rotation of the rotating plate 23*b*.

The second buffer spring 23*h* is configured with a compression spring according to a preferred embodiment and provided around the lower rod 23*g*.

A flange portion larger than a diameter of the second buffer spring 23*h* is provided at a lower end portion of the lower rod 23*g* to prevent the second buffer springs 23*h* from detaching downward.

The second buffer spring 23*h* absorbs an impact from a lower side applied to the lower rod 23*g*.

On the other hand, the configuration of the driving lever latch 29 of the magnetic trip device 20 according to a preferred embodiment of the present disclosure will be described with reference to FIGS. 3, 5, 7 through 8.

Even when the plunger 21*a* is moved to a retracted position by the automatic reset mechanism 23, the driving lever latch 29 can rotate to a restraining position for preventing the switch driving lever 26 of the switch driving lever mechanism 26, 27 from rotating to the first position so as to maintain a trip indication state of the micro switch 28 subsequent to a trip operation. Or the driving lever latch 29 can rotate to a releasing position for allowing the rotation of the switch driving lever 26 to rotate to the first position.

The driving lever latch 29 is provided adjacent to the switch driving lever mechanism.

The driving lever latch 29 comprises a rotating shaft portion 29*a*, a hook portion 29*b* and a release drive force receiving portion 29*c*.

The rotating shaft portion 29*a* is a portion that provides a central axis portion to allow the switch driving lever 29 to rotate. The rotating shaft portion 29*a* may be formed integrally with the driving lever latch 29 such that both end portions of the rotating shaft portion 29*a* are inserted into and supported by a pair of shaft support groove portions provided on a side wall of the enclosure of the magnetic trip device 20 or may be configured separately from the driving lever latch 29 such that the both end portions are inserted into and supported by the shaft support groove portions.

The hook portion 29*b* is extended toward the switch driving lever 26 of the switch driving lever mechanisms 26, 27 from the rotating shaft portion 29*a* to restrain (lock) the switch driving lever 26 of the switch driving lever mechanisms 26, 27.

The hook portion 29*b* is rotatable around the rotating shaft portion 29*a* to a position for locking the third lever portion 26*c* of the switch driving lever 26 and a position for releasing the third lever portion 26*c*.

The position (state) of locking the third lever portion 26*c* of the switch driving lever 26 can be voluntarily implemented by the third lever portion 26*c* when the third lever portion 26*c* rotates in a clockwise direction in the drawing by the elastic pressing of the driving lever bias spring 32 in a state of alarming that the circuit breaker is in a trip state. In other words, when the third lever portion 26*c* rotates in a clockwise direction in the drawing, the hook portion 29*b* rides over a front end portion of the third lever portion 26*c* formed on a inclined surface or a curved surface to restrain (lock) the third lever portion 26*c*.

The position (state) at which the driving lever latch 29 releases the third lever portion 26*c* is achieved by the pressing the driving lever latch 29 of the manual reset lever 31.

The manual reset lever 31 includes a pressing protrusion portion 31*a* that presses the driving lever latch 29 in order to drive the driving lever latch 29 to the release position.

The release drive force receiving portion 29*c* is extended from the rotating shaft portion 29*a* to an opposite side of the hook portion 29*b* and contacts with the manual reset lever 31.

Figure 8:
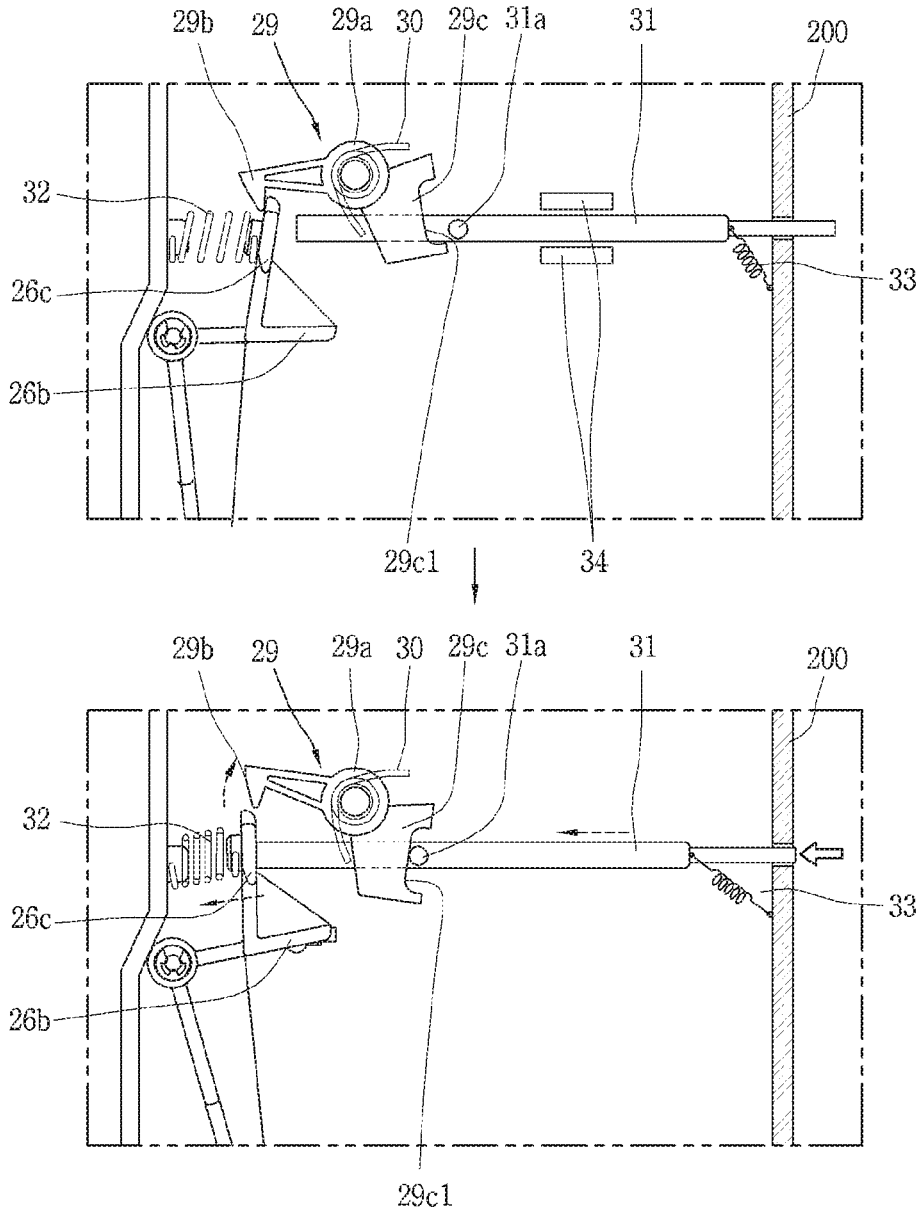
FIG. 8 is an enlarged essential part view in which the operation states of a driving lever bias spring, a switch driving lever, a driving lever latch, and a manual reset lever in the magnetic trip device according to an embodiment of the present disclosure are separately enlarged, wherein an upper drawing thereof is an enlarged essential part view in a state where it is locked in an alarm indicating state, and a lower drawing thereof is an enlarged essential part view in which the driving lever latch releases the locking of the switch driving lever to stop alarm indicating by the operation of the manual reset lever.

Referring to FIG. 8, for the release driving force receiving portion 29*c*, a surface facing the pressing protrusion portion 31*a* is configured with an inclined surface 29*c*1 according to a preferred embodiment.

A surface of the release driving force receiving portion 29*c* facing the pressing protrusion portion 31*a* may be configured with the inclined surface 29*c*1, thereby obtaining an effect capable of effectively transforming a pressing force exerted from the manual reset lever 31 into a rotational force of the driving lever latch 31.

The magnetic trip device 20 according to a preferred embodiment of the present disclosure further comprises a bias spring 30 which applies an elastic force to the driving lever latch 31 in one direction. Here, one direction is a counter-clockwise direction in the drawing as a direction of rotation of the hook portion 29*b* of the driving lever latch 29 to a position where the third lever portion 26*c* of the switch driving lever 26 is restrained.

According to a preferred embodiment, the bias spring 30 is configured with a torsion spring.

On the other hand, the configuration of avoiding portions 22*d*, 22*e* in the magnetic trip device 20 according to a preferred embodiment of the present disclosure will be described with reference to FIGS. 5, 7 and 9.

The avoiding portions 22*d*, 22*e* are formed on the output plate 22 to avoid contacting with the switch driving lever mechanisms 26, 27 for a mutual independent operation between the switch driving lever mechanisms 26, 27 and the output plate 22.

According to a preferred embodiment, the avoiding portion can be configured with a concave groove portion 22*d* formed concavely from an upper surface of the output plate 22 to a lower portion thereof as illustrated in FIGS. 5 and 7 on the output plate 22 for the switch driving lever mechanism to avoid the output plate without being interfered with the output plate rotating to an initial position.

Figure 9:
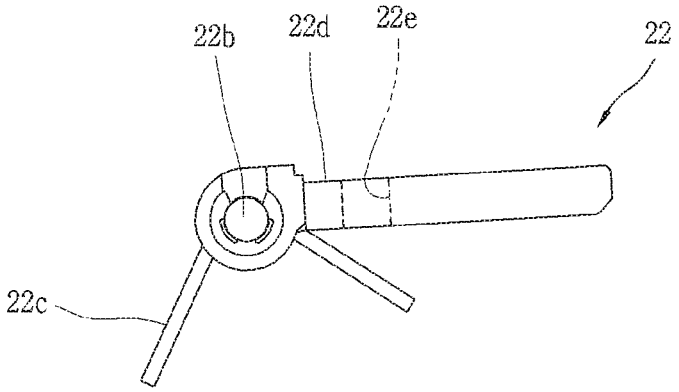
FIG. 9 is a side view illustrating another embodiment of an avoiding portion in the magnetic trip device according to the present disclosure.

According to another preferred embodiment, the avoiding portion can be configured with a through hole portion 22*e* formed to pass through the output plate 22 as illustrated in FIG. 9 for the switch driving lever mechanisms 26, 27 to avoid the output plate 22 without being interfered with the output plate 22.

The magnetic trip device 20 according to a preferred embodiment of the present disclosure further comprises a manual reset lever 31 as illustrated in FIGS. 3, 5, 7 through 9.

The manual reset lever 31 is provided at a position capable of pressing the driving lever latch 29 to press the driving lever latch 29 to rotate to the release position while being moved by a manual operation force.

The manual reset lever 31 is configured with a substantially elongated rod-shaped member, and most of the length thereof is located inside the magnetic trip device 20, but a part thereof may be exposed to the outside through the front plate portion 200 of the circuit breaker. A marking may be provided at a portion of the front plate portion 200 where the manual reset lever 31 is exposed to inform the user that reset of the driving lever latch 29 can be achieved by pressing the exposed portion of the manual reset lever 31.

The magnetic trip device 20 according to a preferred embodiment of the present disclosure may further comprise a pair of guide members 34 formed in a protruding manner on an inner wall surface of the enclosure of the magnetic trip device 20 and formed in a predetermined length to be higher and lower than the manual reset lever 31 so as to guide the manual reset lever 31 to horizontally move due to a manual operation force as illustrated in FIG. 8.

As described above, the manual reset lever 31 has a pressing protrusion portion 31*a* for pressing the release driving force receiving portion 29*c* of the driving lever latch 29 to rotate the driving lever latch 29 to the release position.

The magnetic trip device 20 according to a preferred embodiment of the present disclosure further comprises a lever return spring 33 for returning the manual reset lever 31 to its original position (a position that the exposed portion of the manual reset lever 31 is protruded from the front plate portion 200 outwardly) when there is no external force (for instance, a force pressed by a user's hand) pressing the manual reset lever 31.

According to an embodiment, the lever return spring 33 can be configured with a tension spring, one end of the lever return spring 33 may be connected to the manual reset lever 31 and the other end of the lever return spring 33 may be fixed to a rear surface of the front plate portion 200 directly or through another member.

On the other hand, the operation of the magnetic trip device 20 of the circuit breaker according to a preferred embodiment of the present disclosure will be described with reference to the drawings.

Figure 4:
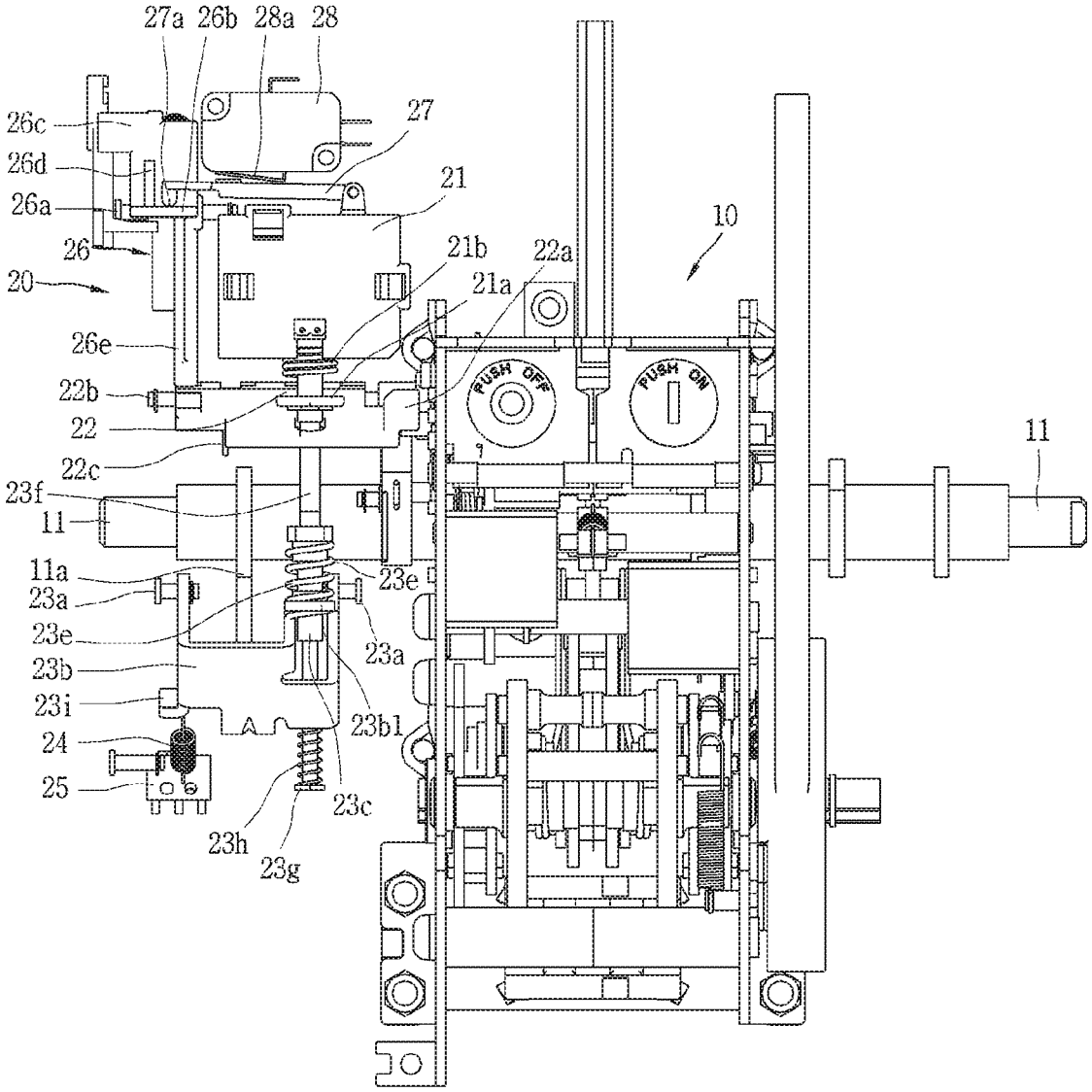
FIG. 4 is a front view illustrating the magnetic trip device according to an embodiment of the present disclosure, the switching mechanism, and the main switching shaft of the circuit breaker in a state where an alarm is being indicated immediately prior to a trip operation in a closing state.

First, a process of operation from the state that the circuit breaker is in a closing state (a so-called ON state) and a state where alarm indicating is stopped as illustrated in FIGS. 2 and 3 into the state that the circuit breaker is in a state immediately prior to a trip operation (a state from the closing state immediately prior to trip) as illustrated in FIGS. 4 and 5 and into a state where is first operated in an alarm indicating state of indicating trip operation will be described with reference to FIGS. 2 through 5.

Here, the operation into an alarm indicating state is first carried out before the circuit breaker operates from a closing state to a trip state.

In the state of FIGS. 2 and 3, it is assumed that the over current relay 300 of FIG. 1 senses the occurrence of a fault current such as an over current or a short-circuit current on a circuit to output a trip control signal for breaking the circuit to the magnetic trip device 20 according to a preferred embodiment of the present disclosure.

Then, the trip control signal is transmitted to the actuator coil part 21 of the magnetic trip device 20 through an unillustrated signal line which is wired as a signal transmission path between the over current relay 300 and the magnetic trip device 20 to magnetize the coil (not shown) of the actuator coil part 21.

The plunger 21*a* presses the lower output plate 22 while advancing according to the magnetization of the coil.

Then, the lower output plate 22 overcomes an elastic force of the return spring 22*c* from a substantially horizontal state as illustrated in FIGS. 2 and 3 and rotates in a clockwise direction as illustrated in FIGS. 4 and 5 to become a state in which one side thereof is inclined downward.

As the output lever 22 rotates in a clockwise direction, the lever pressing portion 22*a* presses the trip lever 10*a* located just below. Therefore, the switching mechanism 10 operates to a trip position due to the displacement of the trip lever 10*a*.

The output plate 22 is rotated in a clockwise direction as illustrated in FIGS. 4 and 5 to release the first lever portion 26*e* of the switch driving lever 26.

As a result, the driving lever bias spring 32 which elastically biases the third lever portion 26*c* of the switch driving lever 26 to rotate in a clockwise direction in the drawing is extended while pushing the third lever portion 26*c*, and thus the switch driving lever 26 is rotated in a clockwise direction as illustrated in FIG. 5.

Accordingly, as the hook portion 29*b* of the driving lever latch 29 facing an upper end portion of the third lever portion 26*c* rides over an upper end portion of the third lever portion 26*c* rotating in a clockwise direction, the third lever portion 26*c* of the switch driving lever 26 is restrained (locked) by the driving lever latch 29 in a state of rotating in a clockwise direction.

Here, the arm contact surface portion 26*b* of the switch driving lever 26 is also disengaged from the power receiving end portion 27*a* of the arm 27 while also rotating in a clockwise direction, and as a result, the arm 27 is rotated from a position illustrated in FIG. 2 to a position illustrated in FIG. 4 in a counter-clockwise direction by its own weight. Therefore, the operation lever portion 28*a* of the micro switch 28 which has been pressed by the arm 27 in FIG. 2 is released.

When the operation lever portion 28*a* is released, a circuit from an electric power source to an output terminal of the micro switch 28 may be connected while an internal contact interlocked with the operation lever portion 28*a* is closed to output an electric signal of a predetermined voltage indicating that the circuit breaker is in a trip operation state from the micro switch 28.

Therefore, the electric signal of the predetermined voltage may operate an outside of the circuit breaker, that is, for instance, an alarm lamp, a buzzer, and the like of a front display and operation panel of a switchgear accommodating the circuit breaker, thereby alarming that the circuit breaker is in a trip operation state in which a fault current is currently broken.

As described above, according to the present disclosure, in a state where the switch driving lever 26 is rotated in a clockwise direction, since the state is restrained by the driving lever latch 29, a trip indicating state can be maintained after the trip operation, thereby preventing the occurrence of an electrical safety accident that may occur by operating the circuit breaker to a closed position (i.e., an ON position).

Figure 6:
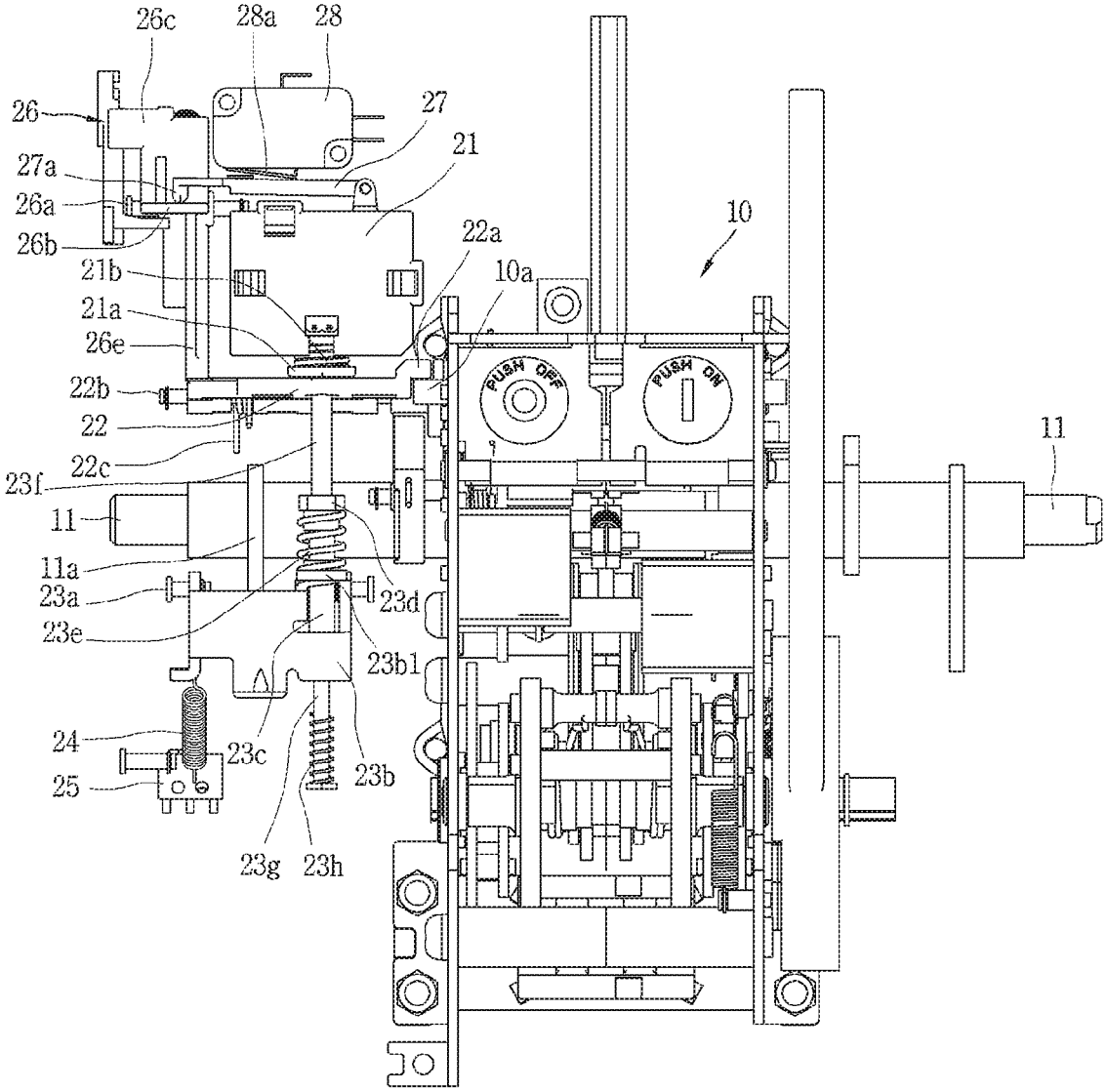
FIG. 6 is a front view illustrating the magnetic trip device according to an embodiment of the present disclosure, the switching mechanism, and the main switching shaft of a circuit breaker in a state in which an actuator coil part is reset to an initial state in a state where an alarm is being indicated.

On the other hand, an operation in which after a trip operation is completed by the operation of the switching mechanism 10 in an alarm indicating state as illustrated in FIGS. 4 and 5, the actuator coil part is reset to an initial state by the automatic reset mechanism as illustrated in FIG. 6 will be described.

When the circuit breaker completes a trip operation, the main switching shaft 11 rotates in a counter-clockwise direction from a state illustrated in FIG. 3 to a state illustrated in FIG. 7.

As the main switching shaft 11 rotates in a counter-clockwise direction, the driving lever 11*a* coupled to the main switching shaft 11 to rotate together also rotates in a counter-clockwise direction.

Referring to FIG. 7, when the circuit breaker is in a trip state, the power receiving portion 23*i* is pushed by the cam surface portion 11*a*1 in contact with the cam surface portion 11*a*1 of the driving lever 11*a* to become a state of being rotated in a counter-clockwise direction from the state illustrated in FIG. 3.

At this time, the rotating plate 23*b* also rotates in a counter-clockwise direction due to a counter-clockwise rotation of the power receiving portion 23*i*, and as a result, the bushing 23*d* connected to the rotating plate 23*b* via the first buffer spring 23*e*, the pressing rod 23*f* and the cylinder 23*c* coupled to the bushing 23*d*, the lower rod 23*g* connected to the cylinder 23*c* by the coupling pin, and the second buffer spring 23*h* provided around the lower rod 23*g* move upward.

Thus, the pressing rod 23*f* moving upward presses the plunger 21*a* of the actuator coil part 21 to return to the retracted position. As a result, the initialization operation of the actuator coil part 21 is completed.

Furthermore, since a pressure of the plunger 21*a* which has pressed the output plate 22 downward is eliminated at this time, the output plate 22 is rotated in a counter-clockwise direction by an elastic force of the return spring 22*c* from a clockwise rotation state as illustrated in FIGS. 4 and 5 to become a horizontal state illustrated in FIGS. 6 and 7.

Furthermore, at this time, though the output plate 22 returns to a horizontal state as illustrated in FIGS. 6 and 7, it is possible to avoid an interference between the output plate 22 rotating in a counter-clockwise direction and the switch driving lever mechanism, particularly, the first lever portion 26*e* as a lower portion of the switch driving lever 26 due to the avoiding portions 22*d*, 22*e* provided on the output plate 22.

Accordingly, even though the output plate 22 returns to a horizontal state, the third lever portion 26*c* of the switch driving lever 26 maintains a state of being restrained by the driving lever latch 29 to allow the micro switch 28 to maintain a trip indicating state subsequent to a trip operation, thereby preventing the occurrence of an electrical safety accident that may occur by operating the circuit breaker to a closed position (i.e., an ON position) in a state where the cause of the trip is not removed.

On the other hand, referring to FIG. 8, an operation for operating the manual reset lever 31 in a state where a fault cause of a trip is removed to initialize the driving lever latch 29 to a release position and stop an alarm indicating operation will be described as follows.

After the circuit breaker trips to remove the cause of a fault current such as an overcurrent or a short circuit on a circuit, the circuit breaker can be operated again to a closing state (an ON state), and maintaining the alarm indicating of the switch driving lever 26 by the driving lever latch 29 to alarm that it is in a trip sate is no longer necessary.

At this time, referring to a lower drawing of FIG. 8, when a user pushes the manual reset lever 31 protruding out of the front plate portion 200 of the circuit breaker in an arrow direction, the pressing protrusion portion 31*a* presses the release drive force receiving portion 29*c* of the driving lever latch 29.

As a result, the driving lever latch 29 rotates in a clockwise direction around the rotating shaft portion 29*a*, and accordingly, the hook portion 29*b* is disengaged (detached) from the third lever portion 26*c* of the switch driving lever 26.

At this time, the first lever portion 26*e*, which is a lower portion of the switch driving lever 26, is pressed upward by the output plate 22 in the state as illustrated in FIGS. 6 and 7, and is rotated in a counter-clockwise direction around the rotating shaft portion 26*a* to become the state as illustrated in FIG. 3.

Accordingly, as illustrated in FIG. 2, the arm contact surface portion 26*b* of the switch driving lever 26 rotating in a counter-clockwise direction presses the arm 27 while moving upward, and as a result, the arm 27 rotates in a clockwise direction to press the operation lever portion 28*a* of the micro switch 28.

Accordingly, the circuit from the electric power source to the output terminal of the micro switch 28 is broken while an internal contact interlocking with the operation lever portion 28*a* is open, the electric signal of the predetermined voltage indicating that the circuit breaker is in a trip operation state is not outputted from the micro switch 28.

Thus, alarm indicating alarming that the circuit breaker is in a trip state is stopped.

Furthermore, at this time, the driving lever bias spring 32 returns to a compressed state in which elastic energy is charged as illustrated in FIG. 3 by a counter-clockwise rotation of the switch driving lever 26.

The effects of the present disclosure will be described as follows.

As described above, a magnetic trip device of a circuit breaker according to the present disclosure includes the driving lever latch so as to lock the micro switch to maintain a trip indicating state subsequent to a trip operation, and includes the automatic reset mechanism so as to automatically initialize the plunger of the actuator coil part to a retracted position which is an initial position in interlocking with the main switching shaft, and include the avoiding portion so as to independently perform a trip operation without being affected by an initial position returning operation of the output plate due to the return spring of the output plate and then restrain the micro switch to maintain the trip indicating state.

A magnetic trip device of a circuit breaker according to the present disclosure further comprises a manual reset lever, and thus the driving lever latch can be forcibly rotated to the release position by manually operating the manual reset lever after removing the cause of a fault, thereby having an effect capable of operating the magnetic trip device to stop a trip indicating state.

In a magnetic trip device of a circuit breaker according to the present disclosure, the driving lever latch comprises a rotating shaft portion, a hook portion and a release driving force receiving portion brought into contact with the manual reset lever, and the manual reset lever is provided with a pressing protrusion portion, and thus the driving lever latch can be rotatable around the rotating shaft portion, and restrain the switch driving lever mechanism by the hook portion, and receive a driving force transmitted from the pressing protrusion portion of the manual reset lever to the release driving force receiving portion, thereby having an effect capable of allowing the driving lever latch to rotate to a release position.

In a magnetic trip device of a circuit breaker according to the present disclosure, in the release driving force receiving portion, a surface facing the pressing protrusion portion is configured with an inclined surface, thereby having an advantage capable of effectively transforming a pressing force from the manual reset lever into a rotational force of the driving lever latch.

In a magnetic trip device of a circuit breaker according to the present disclosure, the automatic reset mechanism comprises the rotating shaft, the rotating plate, the cylinder, the bushing, the pressing rod, the driving lever having the cam surface portion and the power receiving portion, and thus the power receiving portion and the rotating plate can rotate together due to bringing into contact with the cam surface portion of the driving lever when the driving lever rotating together with the main switching shaft of the circuit breaker is moved to a trip position, and the rotation of the rotating plate may cause the cylinder, the bushing and the pressing rod to rise, thereby having an effect capable of allowing the pressing rod to press the plunger of the actuator coil part so as to automatically initialize the position to a retracted position.

In a magnetic trip device of a circuit breaker according to the present disclosure, the automatic reset mechanism further comprises a first buffer spring thereby buffering an impact when the pressing rod moving upward pushes up the plunger to a retracted position, and further comprises a return spring connected to the rotating plate thereby being extended when the main switching shaft is in a trip position so as to charge elastic energy, and the charged elastic energy can be discharged when the main switching shaft is in a closing position, thereby having an effect capable of rotating the rotating plate and the power receiving portion in a first direction to return to an initial position.

In a magnetic trip device of a circuit breaker according to the present disclosure, the switch driving lever mechanism comprises the arm and the switch driving lever, and the switch driving lever comprises the rotating shaft portion, the first lever portion, the arm coupling portion and the third lever portion, thereby having an effect capable of switching the micro switch through the arm contact surface portion and the arm, rotating the first lever portion around the rotating shaft portion according to the output plate, and restraining or releasing the switch driving lever via the third lever portion due to the driving lever latch.

In a magnetic trip device of a circuit breaker according to the present disclosure, the avoiding portion is configured with an avoiding groove portion formed concavely on the output plate, and thus the switch driving lever mechanism can be avoided from the output plate rotating to an initial position without being interfered therewith, thereby having an effect capable of maintaining the switch driving lever mechanism in a trip indicating state regardless of a returning operation of the output plate.

In a magnetic trip device of a circuit breaker according to the present disclosure, the avoiding portion is configured with a through hole portion formed to pass through the output plate, and thus the switch driving lever mechanism may be avoided from the output plate without being interfered therewith, thereby having an effect capable of maintaining the switch driving lever mechanism in a trip indicating state regardless of a returning operation of the output plate.

What is claimed is:

1. A magnetic trip device for a circuit breaker, comprising:

an actuator coil part that has a plunger configured to move to an advanced position or a retracted position according to the magnetization or demagnetization of a coil;

an output plate that is rotatably provided on a movement path of the plunger to rotate in a first direction by the pressing of the plunger;

a micro switch that has an operation lever portion protruding outward and is configured to output an electrical signal indicating a state of the circuit breaker according to whether or not the operation lever portion is pressed;

a switch driving lever mechanism that is configured to rotate to a first position for pressing the operation lever portion and a second position for releasing the operation lever portion so as to open or close the micro switch;

a driving lever bias spring that is provided at a predetermined position to elastically press the switch driving lever mechanism to rotate to the second position;

an automatic reset mechanism that is configured to press the plunger of the actuator coil part to the retracted position in interlocking with a main switching shaft of the circuit breaker subsequent to a trip operation;

a driving lever latch that is configured to rotate to a restraining position for preventing the switch driving lever mechanism from rotating to the first position even when the plunger is moved to the retracted position by the automatic reset mechanism so as to allow the micro switch to maintain a trip indicating state subsequent to a trip operation, and a release position for allowing the switch driving lever mechanism to rotate to the first position, and provided adjacent to the switch driving lever mechanism; and an avoiding portion that is formed on the output plate to avoid contacting with the switch driving lever mechanism for a mutually independent operation between the switch driving lever mechanism and the output plate.

2. The magnetic trip device of claim 1, further comprising:

a manual reset lever that is provided at a position capable of pressing the switch driving lever mechanism and the driving lever latch to press the switch driving lever mechanism to be located at a first position, and pressing the driving lever latch to rotate to the release position while being moved by a manual operation force.

3. The magnetic trip device of claim 2, wherein the driving lever latch comprises:

a rotating shaft portion;

a hook portion that is extended from the rotating shaft portion toward the switch driving lever mechanism to restrain the switch driving lever mechanism; and a release driving force receiving portion that is extended from the rotating shaft portion to an opposite side of the hook portion to contact with the manual reset lever, wherein the manual reset lever comprises a pressing protrusion portion that is configured to press the release driving force receiving portion to rotate the driving lever latch to the release position.

4. The magnetic trip device of claim 3, wherein the release driving force receiving portion is configured such that a surface facing the pressing protrusion portion is an inclined surface.

5. The magnetic trip device of claim 1, wherein the automatic reset mechanism comprises:

a rotating shaft;

a rotating plate that is rotatably supported by the rotating shaft;

a cylinder that has a lower portion located to pass through a through hole of the rotating plate;

a bushing that is provided with a vertical long hole to be coupled to the cylinder by a coupling pin inserted into the long hole;

a pressing rod that is coupled to the bushing to press in direct contact with the plunger of the actuator coil part as an output portion of the automatic reset mechanism;

a driving lever that is coupled to the main switching shaft of the circuit breaker to be rotatable together, the driving lever having a cam surface portion; and a power receiving portion that is provided to extend from the rotating plate toward the driving lever to bring into contact with the cam surface portion of the driving lever to receive power during a trip operation.

6. The magnetic trip device of claim 5, wherein the automatic reset mechanism further comprises:

a first buffer spring that is provided between the bushing and the rotating plate to buffer an impact when the pressing rod pushes up the plunger to the retracted position; and a return spring that is connected to the rotating plate, and tensioned when the main switching shaft is in a trip position to charge elastic energy, and when the main switching shaft is in a closing position to rotate the rotating plate and the power receiving portion in a first direction by discharging the charged elastic energy.

7. The magnetic trip device of claim 1, wherein the switch driving lever mechanism comprises:

an arm that is extending toward the operation lever portion of the micro switch and rotatable to a first position for pressing the operation lever portion of the micro switch and a second position for releasing the operation lever portion; and a switch driving lever that is capable of rotating the arm, wherein the switch driving lever comprises:

a rotating shaft portion;

a first lever portion that is extending from the rotating shaft portion toward the output plate to rotate along the output plate;

an arm contact surface portion that contacts with the arm to transmit a driving force to the arm so as to rotate the arm to the first position or the second position; and a third lever portion that is extending upward from the rotating shaft portion.

8. The magnetic trip device of claim 1, wherein the avoiding portion is formed on the output plate, and configured with a concave groove portion formed in a concave shape to prevent the switch driving lever mechanism from being interfered with the output plate rotating to an initial position.

9. The magnetic trip device of claim 1, wherein the avoiding portion is configured with a through hole portion formed to pass through the output plate such that the switch lever mechanism is avoided without being interfered with the output plate.

* * * * *